US010006160B2

(12) United States Patent
Brockman et al.

(10) Patent No.: US 10,006,160 B2
(45) **Date of Patent: *Jun. 26, 2018**

(54) METHOD FOR DISPENSING AN ENZYME IN A LAUNDRY TREATING APPLIANCE

(71) Applicant: WHIRLPOOL CORPORATION, Benton Harbor, MI (US)

(72) Inventors: Irene M. Brockman, Cambridge, MA (US); Kaustav Ghosh, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 104 days.

This patent is subject to a terminal disclaimer.

(21) Appl. No.: 15/068,592

(22) Filed: Mar. 13, 2016

(65) Prior Publication Data

US 2016/0222575 A1 Aug. 4, 2016

Related U.S. Application Data

(60) Continuation of application No. 13/971,079, filed on Aug. 20, 2013, now Pat. No. 9,322,125, which is a division of application No. 12/638,542, filed on Dec. 15, 2009, now Pat. No. 8,533,881.

(51) Int. Cl.

| | |
|---|---|
| ***D06F 58/20*** | (2006.01) |
| ***D06F 35/00*** | (2006.01) |
| *C11D 3/386* | (2006.01) |

(52) U.S. Cl.

CPC ..... *D06F 58/203* (2013.01); *D06F 35/00* (2013.01); *D06F 35/005* (2013.01); *C11D 3/38627* (2013.01)

(58) Field of Classification Search

CPC ..... D06F 35/00; D06F 35/005; D06F 58/203

See application file for complete search history.

(56) References Cited

U.S. PATENT DOCUMENTS

| | | | |
|---|---|---|---|
| 3,872,604 | A | 3/1975 | Keller |
| 4,207,683 | A | 6/1980 | Horton |
| 5,296,161 | A | 3/1994 | Wiersema et al. |
| 5,547,476 | A | 8/1996 | Siklosi et al. |
| 5,578,489 | A | 11/1996 | Petersen |
| 5,591,236 | A | 1/1997 | Roetker |
| 5,593,779 | A | 1/1997 | Mori et al. |
| 5,630,848 | A | 5/1997 | Young et al. |
| 5,681,355 | A | 10/1997 | Davis et al. |
| 5,840,675 | A | 11/1998 | Yeazell |
| 5,912,408 | A | 6/1999 | Trinh et al. |
| 6,051,033 | A | 4/2000 | McDevitt et al. |
| 6,171,346 | B1 | 1/2001 | Yeazell et al. |
| 6,262,009 | B1 | 7/2001 | Rogers et al. |
| 6,265,191 | B1 | 7/2001 | Mizusawa et al. |
| 6,446,357 | B2 | 9/2002 | Woerdehoff et al. |

(Continued)

FOREIGN PATENT DOCUMENTS

| | | |
|---|---|---|
| DE | 10114256 A1 | 10/2002 |
| EP | 0476915 A2 | 3/1992 |

(Continued)

OTHER PUBLICATIONS

German Search Report for DE102010036565, dated Feb. 29, 2012.

*Primary Examiner* — Joseph L. Perrin

(57) ABSTRACT

A method for treating laundry in a laundry treating appliance including the application of an enzyme solution to the laundry during a cycle of operation.

15 Claims, 7 Drawing Sheets

(56) References Cited

U.S. PATENT DOCUMENTS

| | | | |
|---|---|---|---|
| 6,642,195 | B2 | 11/2003 | Hage |
| 6,811,811 | B2 | 11/2004 | Gerald France et al. |
| 6,939,837 | B2 | 9/2005 | Noyes et al. |
| 6,966,696 | B1 | 11/2005 | Curry et al. |
| 7,056,880 | B2 | 6/2006 | Wang et al. |
| 7,059,065 | B2 | 6/2006 | Gerlach et al. |
| 7,300,468 | B2 | 11/2007 | Wright et al. |
| 7,503,127 | B2 | 3/2009 | Duval et al. |
| 7,513,132 | B2 | 4/2009 | Wright et al. |
| 7,528,102 | B2 | 5/2009 | Barthel et al. |
| 7,534,304 | B2 | 5/2009 | Conrad et al. |
| 2001/0014659 | A1 | 8/2001 | Convents et al. |
| 2005/0183208 | A1 | 8/2005 | Scheper et al. |
| 2007/0151129 | A1 | 7/2007 | McAllister et al. |
| 2008/0276966 | A1 | 11/2008 | Yusuf et al. |
| 2009/0113745 | A1 | 5/2009 | Choi et al. |
| 2010/0011511 | A1 | 1/2010 | Baltsen et al. |

FOREIGN PATENT DOCUMENTS

| | | | |
|---|---|---|---|
| EP | 0835340 | A1 | 4/1998 |
| EP | 1240378 | A1 | 9/2002 |
| GB | 2303150 | A | 2/1997 |
| WO | 9113136 | A1 | 9/1991 |

METHOD FOR DISPENSING AN ENZYME IN A LAUNDRY TREATING APPLIANCE

CROSS REFERENCE TO RELATION APPLICATIONS

This application is a continuation of U.S. patent application Ser. No. 13/971,079, filed Aug. 20, 2013, now U.S. Pat. No. 9,322,125, issued Apr. 26, 2016, which is a divisional of U.S. patent application Ser. No. 12/638,542, filed Dec. 15, 2009, now U.S. Pat. No. 8,533,881, issued Sep. 17, 2013, both of which are incorporated herein by reference in their entirety.

BACKGROUND OF THE INVENTION

Oil and grease stains are difficult to remove from clothing items and other fabrics in automated laundry treating appliances where the entire laundry load must be treated the same, as compared to manual spot treatment of individual stains by a user. Enzymes, such as lipases, are sometimes included in detergent compositions to facilitate removal of oil and grease stains during a cycle of operation in a clothes washer. However, other components of the detergent composition may decrease the effectiveness of lipases in removing oil and grease stains during a wash cycle. For example, the presence of surfactants, proteases and bleaches may inactivate or otherwise decrease the effectiveness of lipases in removing stains during a wash cycle.

BRIEF DESCRIPTION

In one aspect, a method of treating laundry in a laundry treating appliance having an air supply system and a heating system both operably coupled to and controlled by a controller to supply heated air to a treating chamber, the method comprising pre-treating by adding moisture to the laundry in the treating chamber until a sensed moisture content of the laundry satisfies a first predetermined moisture content threshold; after the satisfying of the first predetermined moisture content threshold, applying an enzyme solution to the laundry in the treating chamber until the sensed moisture content of the laundry is greater than a second predetermined moisture content threshold, which is greater than the first predetermined moisture content threshold; and after the application of the enzyme solution, supplying the heated air to the treating chamber to reduce the sensed moisture content of the laundry.

In another aspect, a method of treating laundry in a laundry treating appliance having an air supply system and a heating system both operably coupled to and controlled by a controller to supply heated air to a rotatable drum defining a treating chamber, the method comprising: determining a remaining moisture content of the laundry based on output from a moisture sensor; reducing the moisture content of the laundry in the treating chamber until the moisture content of the laundry satisfies a first predetermined moisture content threshold based on the output from the moisture sensor, wherein the first predetermined moisture content threshold is based on a moisture content corresponding to a desired activity of at least one enzyme to be applied to the laundry in the treating chamber; after the satisfying of the first predetermined moisture content threshold, applying an enzyme to the laundry in the treating chamber until the moisture content of the laundry satisfies a second predetermined moisture content threshold based on the output from the moisture sensor, which is greater than the first predetermined moisture content threshold; and after the application of the enzyme, supplying heated air to the treating chamber to reduce the moisture content of the laundry to satisfy the first predetermined moisture content threshold.

DESCRIPTION OF AN EMBODIMENT OF THE INVENTION

Figure 1:
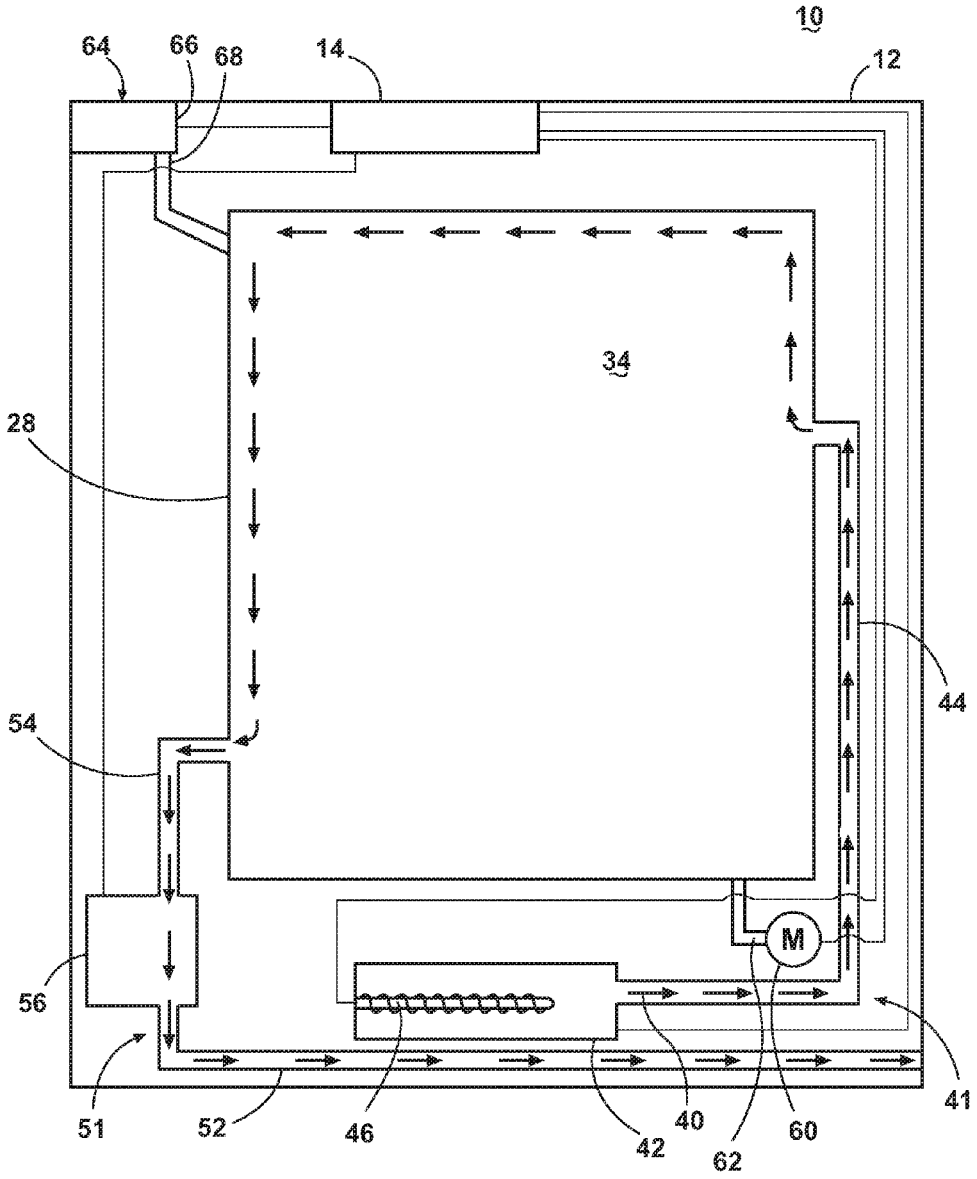
FIG. 1 is a schematic view of a laundry treating appliance according to a first embodiment of the invention.

FIG. 1 illustrates one embodiment of a laundry treating appliance 10 in the form of a clothes dryer according to the invention. While the laundry treating appliance 10 is illustrated as a clothes dryer, the laundry treating appliance 10 according to the invention may be any appliance which performs a cycle of operation on laundry, non-limiting examples of which include a horizontal or vertical axis clothes dryer; a combination washing machine and dryer; a tumbling or stationary refreshing/revitalizing machine; an extractor; a non-aqueous washing apparatus; and a revitalizing machine. The laundry treating appliance 10 described herein shares many features of a traditional automatic clothes dryer, which will not be described in detail except as necessary for a complete understanding of the invention.

The laundry treating appliance 10 may comprise a cabinet 12 having a controller 14 for controlling the operation of the laundry treating appliance 10 to complete a cycle of operation. A rotatable drum 28 may be located within the cabinet 12 defining a treating chamber 34 for receiving laundry to be treated during a cycle of operation.

Still referring to FIG. 1, an air flow system for the clothes dryer 10 according to one embodiment of the invention will now be described. As illustrated by arrows 40, the air flow system supplies air to the treating chamber 34 and then exhausts air from the treating chamber 34. The supplied air may be heated or not. The air flow system may have an air supply portion 41 that may be formed in part by an inlet conduit 42, which has one end open to the ambient air and another end fluidly coupled to an inlet channel 44, which may be in fluid communication with the treating chamber 34. A heating element 46 may lie within the inlet conduit 42 and may be operably coupled to and controlled by the controller 14. If the heating element 46 is turned on, the supplied air will be heated prior to entering the drum 28.

The air supply system may further include an air exhaust portion 51 that may be formed in part by an exhaust conduit 52 and exhaust channel 54, which are fluidly coupled by a blower 56. The blower 56 may be operably coupled to and controlled by the controller 14. Operation of the blower 56 draws air into the treating chamber 34 as well as exhausts air from the treating chamber 34 to the outside of the laundry treating appliance 10 through the exhaust conduit 52.

The drum 28 may be rotated by any suitable drive mechanism, such as an indirect drive, which is illustrated as a motor 60 and a coupled belt 62. Some non-limiting examples of indirect drive are: three-phase induction motor drives, various types of single phase induction motors such as a permanent split capacitor (PSC), a shaded pole and a split-phase motor. Alternately, the motor 60 may be a direct drive motor, as is known in the art. Some non-limiting examples of an applicable direct drive motor are: a brushless permanent magnet (BPM or BLDC) motor, an induction motor, etc. The motor 60 may be operably coupled to the controller 14 to control the rotation of the drum 28 to complete a cycle of operation.

The clothes dryer 10 may also include a dispensing system 64 for dispensing treatment chemistries, including without limitation water, steam and any treatment composition individually or collectively into the treating chamber 34, and thus may be considered to be a dispensing dryer. The treatment chemistry may be in a form of gas, liquid, aerosol, solid or any combination thereof and may have any chemical composition enabling improved wrinkle, odor, softness, whitening, brightening, addition of fragrance, or any other desired treatment of the laundry.

The dispensing system 64 may include a dispenser 66 capable of holding and dispensing a treatment chemistry to the treating chamber 34 through a dispensing line 68. The dispenser 66 may be positioned to direct the treatment chemistry at the inner surface of the drum 28 so that laundry may contact and absorb the chemistry, or to dispense the chemistry directly onto the laundry in the treating chamber 34. The dispensing system may dispense one or more chemistries in any desired sequence or combination.

The specific type of dispensing system 64 is not germane to the invention and may include additional components such as a chemistry meter to control the amount of treatment chemistry dispensed. Additionally or alternatively, the dispensing system 64 may include a steam generator for dispensing steam as a treatment chemistry or with a treatment composition into the treating chamber 34. The treatment composition may be dispensed in any form such as a mist, spray, aerosol, stream or droplets, for example. The dispensing system 64 may be operably coupled with the controller 14 for dispensing one or more treatment chemistries one or more times during a course of operation.

Figure 2:
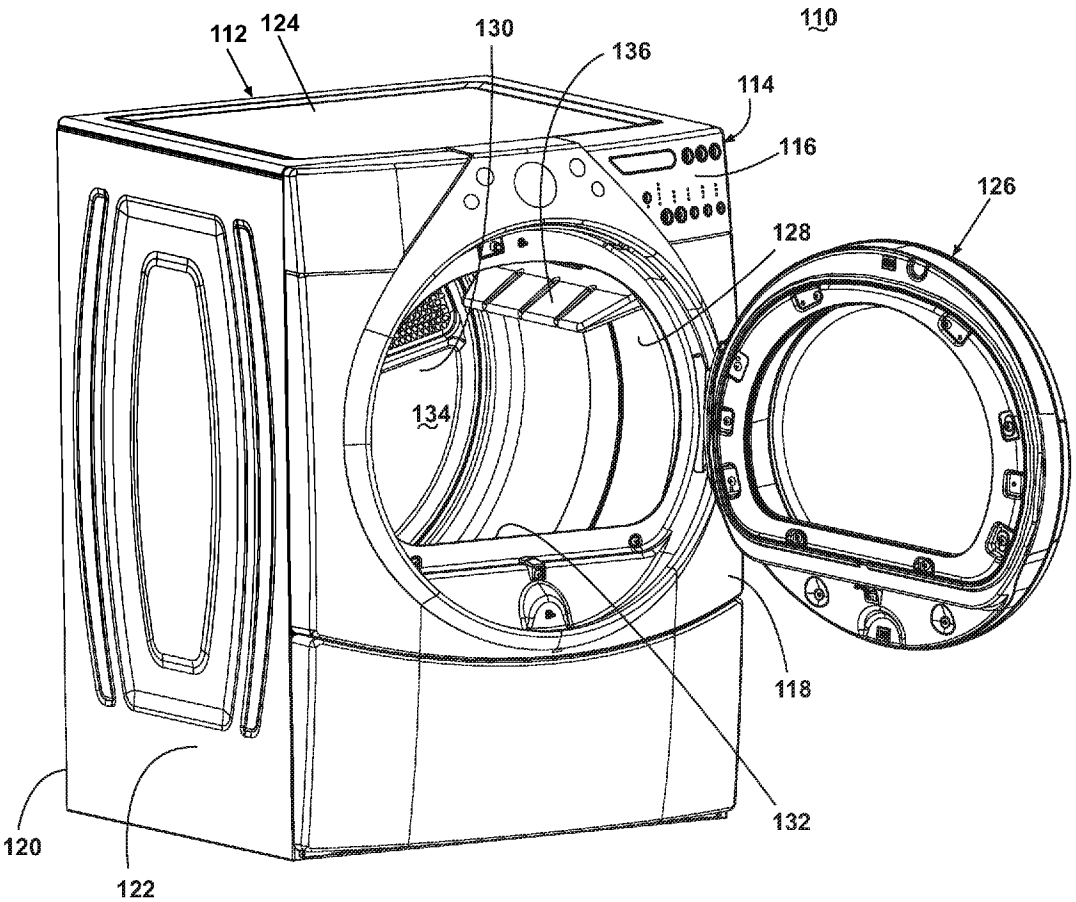
FIG. 2 is a front perspective view of a clothes dryer according to a second embodiment of the invention.

FIG. 2 illustrates a second embodiment of the invention in the form of a clothes dryer 110 which is similar in structure to the laundry treating appliance 10. Therefore, elements in the clothes dryer 110 similar to the laundry treating appliance 10 will be numbered with the prefix 100. The clothes dryer 110 described herein shares many features of a traditional automatic clothes dryer which will not be described in detail except as necessary for a complete understanding of the invention.

The clothes dryer 110 may include a cabinet 112 in which is provided a controller 114 that may receive input from a user through a user interface 116 for selecting a cycle of operation and controlling the operation of the clothes dryer 110 to implement the selected cycle of operation.

The cabinet 112 may be defined by a front wall 118, a rear wall 120, and a pair of side walls 122 supporting a top wall 124. A door 126 may be hingedly mounted to the front wall 118 and may be selectively moveable between opened and closed positions to close an opening in the front wall 118, which provides access to the interior of the cabinet.

A rotatable drum 128 may be disposed within the interior of the cabinet 112 between opposing stationary rear and front bulkheads 130 and 132, which collectively define a treating chamber 134, for treating laundry, having an open face that may be selectively closed by the door 126. Examples of laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be dried in the clothes dryer 110.

The drum 128 may include at least one lifter 136. In most dryers, there are multiple lifters. The lifters 136 may be located along the inner surface of the drum 128 defining an interior circumference of the drum 128. The lifters 136 may facilitate movement of the laundry within the drum 128 as the drum 128 rotates.

Figure 3:
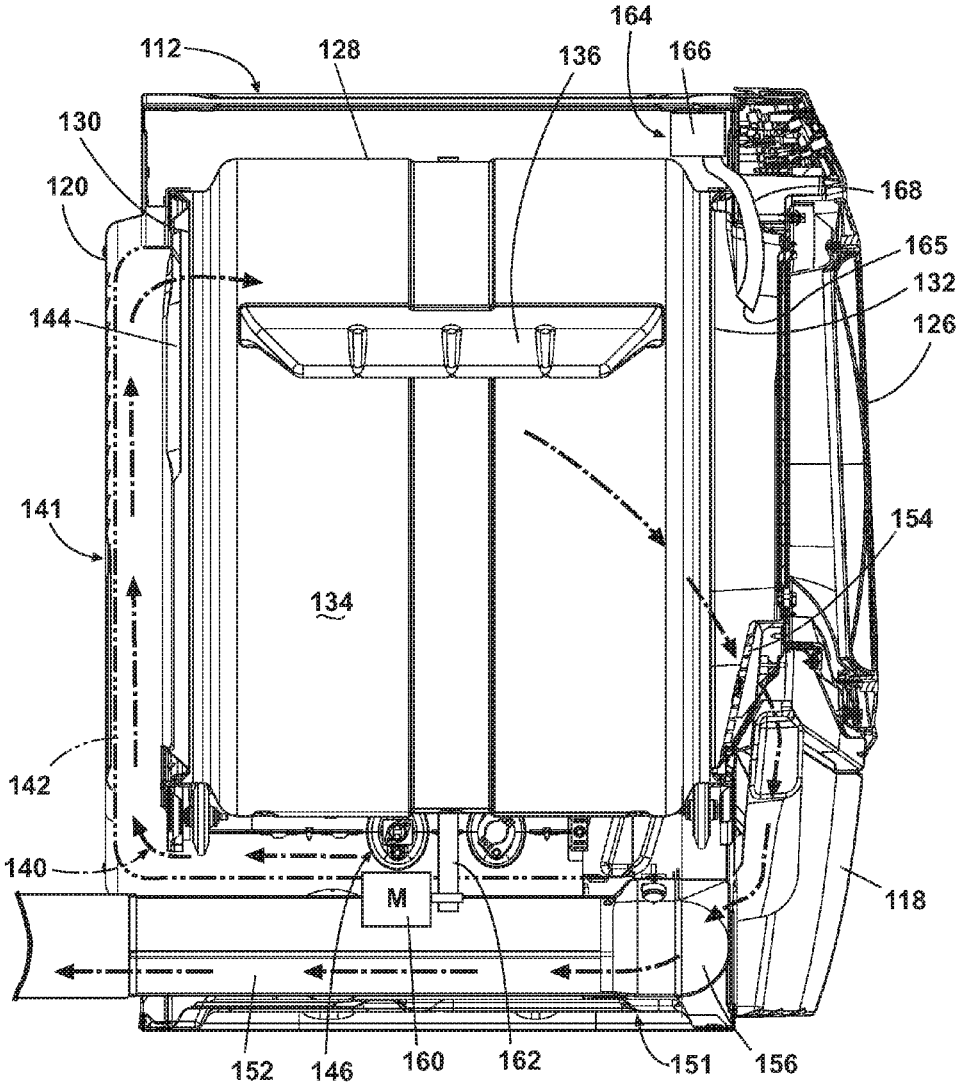
FIG. 3 is a cross sectional view of the clothes dryer of FIG. 2 according to the second embodiment of the invention.

Referring now to FIG. 3, an air flow system for the clothes dryer 110 according to one embodiment of the invention will now be described. As illustrated by arrows 140, the air flow system supplies air to the treating chamber 134 and then exhausts air from the treating chamber 134. The supplied air may be heated or not. The air flow system may have an air supply portion 141 that may be formed in part by an inlet conduit 142, which has one end open to the ambient air and another end fluidly coupled to an inlet grill 144, which may be in fluid communication with the treating chamber 134. A heating element 146 may lie within the inlet conduit 142 and may be operably coupled to and controlled by the controller 114. If the heating element 146 is turned on, the supplied air will be heated prior to entering the drum 128.

The air supply system may further include an air exhaust portion 151 that may be formed in part by an exhaust conduit 152 and lint trap 154, which are fluidly coupled by a blower 156. The blower 156 may be operably coupled to and controlled by the controller 114. Operation of the blower 156 draws air into the treating chamber 134 as well as exhausts air from the treating chamber 134 through the exhaust conduit 152. The exhaust conduit 152 may be fluidly coupled with a household exhaust duct 157 for exhausting the air from the treating chamber 134 to the outside.

Still referring to FIG. 3, as is typical in a clothes dryer, the drum 128 may be rotated by a suitable drive mechanism, such as an indirect drive, which is illustrated as a motor 160 and a coupled belt 162. Some non-limiting examples of indirect drive are: three-phase induction motor drives, various types of single phase induction motors such as a permanent split capacitor (PSC), a shaded pole and a split-phase motor. Alternately, the motor 160 may be a direct drive motor, as is known in the art. Some non-limiting examples of an applicable direct drive motor are: a brushless permanent magnet (BPM or BLDC) motor, an induction motor, etc. The motor 160 may be operably coupled to the controller 114 to control the rotation of the drum 128 to complete a cycle of operation.

The motor 160 may rotate the drum 128 at various speeds in opposite rotational directions. In particular, the motor 160 can rotate the drum 128 at tumbling speeds wherein the fabric items in the drum 128 rotate with the drum 128 from a lowest location of the drum 128 towards a highest location of the drum 128, but fall back to the lowest location of the drum 128 before reaching the highest location of the drum 16. The rotation of the fabric items with the drum 128 may be facilitated by the lifters 136. Typically, the force applied to the fabric items at the tumbling speeds is less than about 1 G. Alternatively, the motor 160 may rotate the drum 128 at spin speeds wherein the fabric items rotate with the drum 128 without falling. In the washing machine art, the spin speeds may also be referred to as satellizing speeds or sticking speeds. Typically, the force applied to the fabric items at the spin speeds is greater than or about equal to 1 G. As used herein, "tumbling" of the drum 128 refers to rotating the drum at a tumble speed, "spinning" the drum 128 refers to rotating the drum 128 at a spin speed, and "rotating" of the drum 128 refers to rotating the drum 16 at any speed.

The clothes dryer 10 may also have a dispensing system 164 for dispensing treatment chemistries, including without limitation water, steam and any treatment composition individually or collectively into the treating chamber 134, and thus may be considered to be a dispensing dryer. The dispensing system 164 may include a dispenser 166 capable of holding and dispensing one or more treatment chemistries into the treating chamber 134. The dispenser 166 may be fluidly coupled with at least one outlet 165 in fluid communication with the treating chamber 134 through a dispensing line 168. The outlet 165 may be positioned to direct the treatment chemistry at the inner surface of the drum 128 so that laundry may contact and absorb the chemistry, or to dispense the chemistry directly onto the laundry in the treating chamber 134.

The type of dispensing system 164 is not germane to the invention and may include additional components such as a chemistry meter to control the amount of treatment chemistry dispensed and/or a mixing chamber to dilute a chemistry treatment to a desired concentration. One example of a dispensing system suitable for use according to the invention is disclosed in commonly-owned U.S. patent application Ser. No. 12/165,712, filed Jul. 1, 2008, titled "A Household Cleaning Appliance with a Dispensing System Operable Between a Single Use Dispensing System and a Bulk Dispensing System." Additionally or alternatively, the dispensing system 164 may include a steam generator for dispensing steam as a treatment chemistry into the treating chamber 134. The treatment composition may be dispensed in any form such as a mist, spray, aerosol, stream or droplets, for example. The treatment chemistry may be in a form of gas, liquid, solid or any combination thereof and may have any chemical composition enabling improved wrinkle, odor, softness, whitening, brightening, addition of fragrance, or any other desired treatment of the laundry.

Figure 4:
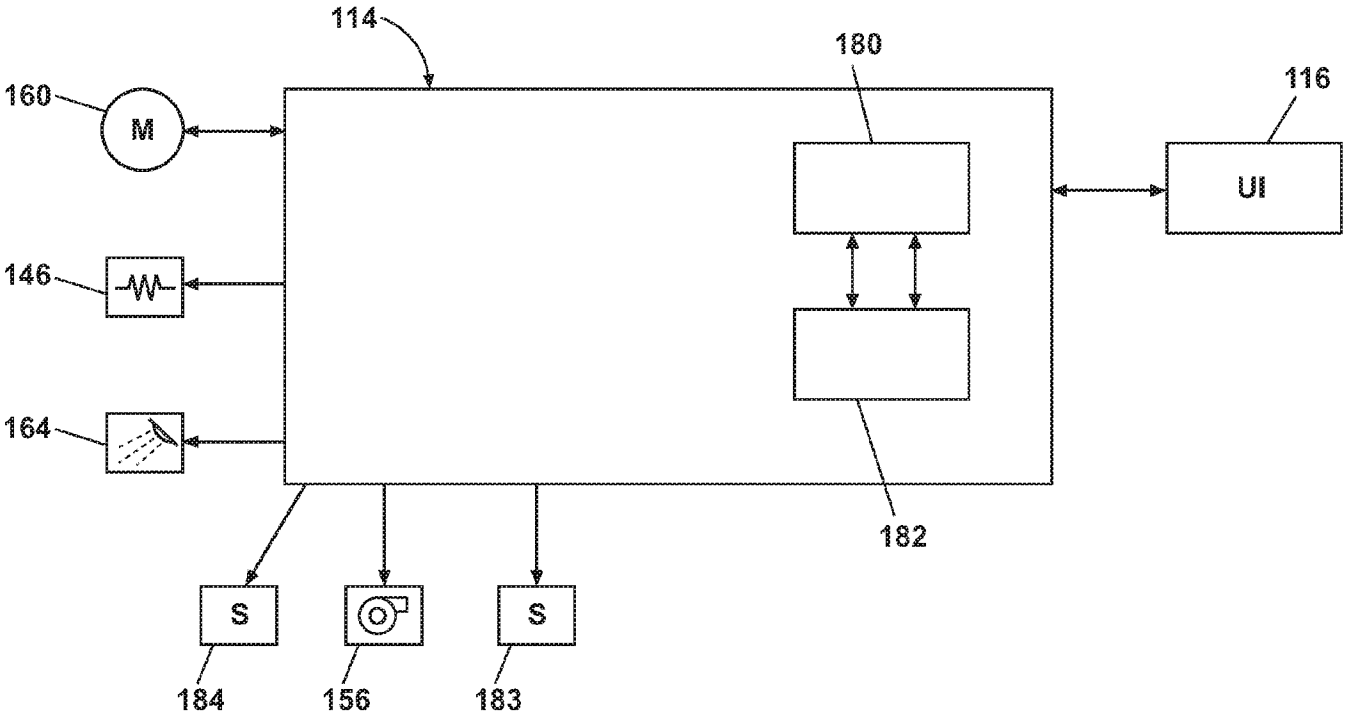
FIG. 4 is a schematic representation of a controller for controlling the operation of one or more components of the laundry treating appliance of FIG. 2 according to the second embodiment of the invention.

As illustrated in FIG. 4, the controller 114 may be provided with a memory 180 and a central processing unit (CPU) 182. It is contemplated that the controller 114 is a microprocessor-based controller that is programmed to implement control software stored in the memory 180 which may be internal to or in communication with the microprocessor. The memory 180 may comprise one or more software applications, and send/receive one or more electrical signals to/from each of the various working components to affect the control software. Examples of possible controllers are: proportional control (P), proportional integral control (PI), and proportional derivative control (PD), or a combination thereof, a proportional integral derivative control (PID control), which may be used to control the various components of the clothes dryer 110.

The controller 114 may be communicably and/or operably coupled with one or more components of the clothes dryer 110 for communicating with and controlling the operation of the component to complete a cycle of operation. For example, the controller 114 may be coupled with the heating element 146 and the blower 156 for controlling the temperature and flow rate of air through the treating chamber 134; the motor 160 for controlling the direction and speed of rotation of the drum 128; and the dispensing system 164 for dispensing a treatment chemistry during a cycle of operation. The controller 114 may also be coupled with the user interface 116 for receiving user selected inputs and communicating information to the user.

The controller 114 may also receive input from various sensors, which are known in the art and not shown for simplicity. Non-limiting examples of sensors that may be communicably coupled with the controller 114 include one or more: air flow rate sensors, moistures sensors, temperature sensors, weight sensors, and motor torque sensors.

For example, the air supply portion 141 and/or the air exhaust portion 151 may include one or more temperature sensors 183 for determining the temperature of the air flowing through the treating chamber 134 and/or the temperature of the laundry load. The temperature sensor 148 may be any suitable type of temperature sensor such as a thermistor, thermocouple or RTD, for example. The temperature of the laundry may be determined using any suitable method, such as that disclosed in Applicant's copending application bearing Applicant's reference number U.S.20080838, titled "Fabric Temperature Estimation for a Laundry Dryer."

In another example, the treating chamber 134 may be provided with one or more moisture sensors 184 that may be used by the controller 114 to estimate the remaining moisture content (RMC) of the laundry. The RMC of the laundry may be estimated using any suitable method. For example, the RMC of the laundry may be based on the readings of one or more moisture sensors in the form of conductivity strips, such as is described in U.S. Pat. No. 6,446,357 to Woerdehoff et al.

The specific manner in which the RMC and the temperature of the load are determined is not germane to the invention and therefore it is within the scope of the invention for any suitable method to be used to determine the RMC and the temperature of the load.

Examples of user-selectable cycles of operation may include cycles that are typically conducted on dry laundry, which as used herein refers to laundry that contains no moisture above that which is naturally present within the fabric based on the humidity of the environment in which the laundry is stored and cycles which are typically conducted on moist laundry, which as used herein refers to laundry that has some degree of moisture that a user desires to remove. Non-limiting examples of a cycle of operation that may be performed on laundry that is already dry include, a refresh cycle, a deodorizing cycle and a touch-up/wrinkle-removing cycle. Non-limiting examples of a cycle of operation that may be performed on moist laundry include a normal drying cycle, a jeans drying cycle, a heavy duty drying cycle and a delicates drying cycle.

The previously described laundry treating appliances 10 and 110 may be used to implement one or more embodiments of a method of the invention. Several embodiments of the method will now be described in terms of the operation of the clothes dryer 110. The sequence of steps depicted is for illustrative purposes only, and is not meant to limit the embodiments of the method in any way as it is understood that the steps may proceed in a different logical order or additional or intervening steps may be included without detracting from the invention. While the embodiments of the methods are described with respect to the clothes dryer 110, the embodiments of the methods may also be used with the laundry treating appliance 10 of the first embodiment of the invention. The embodiments of the method function to apply a chemistry treatment composition comprising at least one lipase to a load of laundry.

Lipases are enzymes that are used in living organisms to hydrolyze triglycerides, which are present in fats and oils, into their component fatty acid and glycerol molecules. Enzymes may be used in laundry treatment compositions to breakdown water-insoluble soils and stains into smaller, more water-soluble components that are easier to remove from fabric. Lipases, for example, may be used to remove fatty and/or oily food and body stains, which typically contain triglycerides, from fabric by breaking the fatty stains into components that are easier to remove from the fabric, such as fatty acids and glycerol molecules. One example of a lipase solution suitable for use in removing fatty stains from fabrics is Lipolase®, available from Novozymes. Additional examples of lipases suitable for use in removing stains from fabric include those which may be isolated from *Pseudomonas* organisms, such as *P. putida* ATCC 53552, or from an organism expressing a coding region found in or cloned from the *Pseudomonas*. It is also within the scope of the invention for any type of lipase from any source to be used. The lipases may be biological or engineered lipases that are extracted from living organisms or combinations thereof.

The activity of lipases, and therefore, the effectiveness of lipases at removing stains from fabrics, may be effected by several factors including, concentration, temperature, pH and moisture content of the fabric. The embodiments of the method function to control the concentration, temperature, pH and moisture of the laundry load and the lipase solution to improve the removal of stains from fabric during a cycle of operation in a clothes dryer.

As used herein, a lipase solution may comprise an aqueous or non-aqueous based solution that may include one or more lipases. It is also within the scope of the invention for the lipase solution to comprise other components, non-limiting examples of which include one or more additional types of enzymes, detergents, fragrances, anti-wrinkle agents and anti-static agents and combinations thereof.

One factor that may effect the activity of a lipase is the pH of the lipase environment. Typically, lipases that are used to treat laundry exhibit optimal activity at alkaline or basic conditions having a pH in the range of 7-11. In addition, the hydrolysis products of lipases, such as the fatty acids, for example, are more soluble under basic conditions. To obtain optimal lipolytic activity, the lipase solution should be near the pH corresponding to the optimal activity for the particular lipase or lipases in the lipase solution. The lipase solution may be prepared using one or more buffers to buffer the solution at a pH that is near the optimal pH for the lipase or lipases present in the lipase solution. If the lipase solution includes multiples lipases having different optimal pHs, the lipase solution may be buffered so as to optimize the lipolytic activity of the lipase solution as a whole rather than just an individual lipase. Examples of suitable buffers include a phosphate or carbonate buffer. For example, experiments conducted by the Applicants found improved activity of a 20 ppm Lipolase® solution in a 9.4 mM sodium carbonate solution compared to 20 ppm Lipolase® solution in unbuffered water.

Another factor that may effect the activity of a lipase solution on fabrics are the moisture conditions of the fabric. It has been shown that Lipolase® exhibits increased activity when the fabric has a moisture content in the range of approximately 20-30%. The optimal moisture content may vary depending on the specific enzyme or enzymes present in the solution.

Another factor that may effect the activity of the lipase solution is the temperature. Lipases typically have a range of temperatures at which they exhibit a range of activity and a smaller range of temperatures at which the activity of the lipase is at a maximum. For example, lipases that are typically used in laundry detergent solutions exhibit maximum activity around 50-65° C., although the exact temperature may vary depending on the specific lipase. At certain temperatures, the lipase may become inactivated, sometimes permanently. In this manner, temperature may be used to control the optimization of the lipolytic activity both in terms of maximizing and minimizing lipolytic activity.

Figure 5:
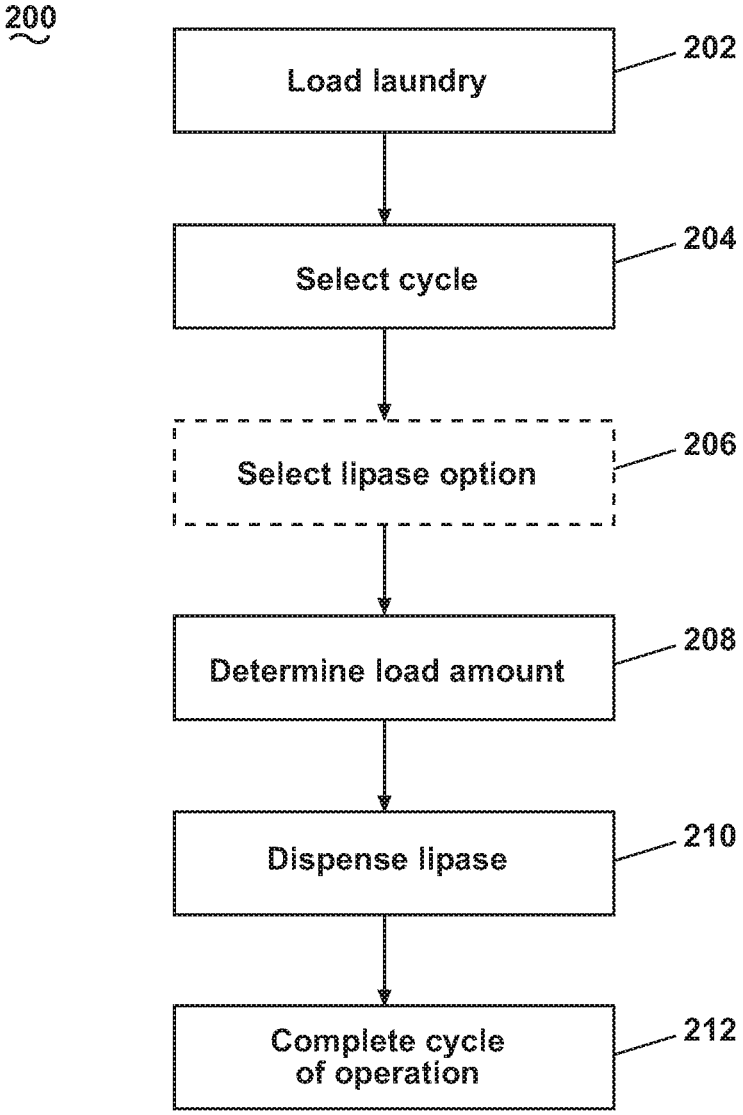
FIG. 5 is a flow chart illustrating a method for dispensing a lipase solution to a load of laundry according to a third embodiment of the invention.

FIG. 5 illustrates a method 200 for dispensing a lipase solution to a load of laundry within the treating chamber 134 of the clothes dryer 110. The method 200 assumes that a user has provided the appropriate treatment chemistry or chemistries to the dispensing system 164, including the desired lipase solution. At 202, a user may place the laundry load within the treating chamber 134. At 204, the user may select a cycle of operation through the user interface 116. One or more user selectable cycles may be pre-programmed to include a lipase dispensing phase. Alternatively, at 206 the user may be provided with the option, such as by a button on the control panel, to select a lipase dispensing phase to be included in the cycle of operation selected by the user at 204. Non-limiting examples of user selectable cycles of operation may include cycles that are typically conducted on dry laundry, such as a refresh cycle, a deodorizing cycle and a touch-up/wrinkle-removing cycle and cycles that are typically conducted on moist laundry, such as a normal drying cycle, a jeans drying cycle and a delicate drying cycle.

At 206 the controller 114 may determine the amount of laundry within the treating chamber 134. Determining the load amount may be done automatically or manually based on user input. Determining the load amount may include determining the volume, density, mass, weight and one or more dimensions of the load and may be determined using any suitable method, such as by a weight sensor, user input of the weight, deriving the weight from the motor torque signal; all of which are known in the art. The load amount may be based on a measurable quantity such as kilograms, for example, or a qualitative measurement, such as small, medium or large.

At 210 the controller 114 may control the operation of the clothes dryer 110 to dispense the lipase solution according to the cycle selected at 204, or the option at 206, and the load amount determined at 208. At 212 the controller may control the operation of the clothes dryer 110 to complete the cycle of operation.

Figure 6:
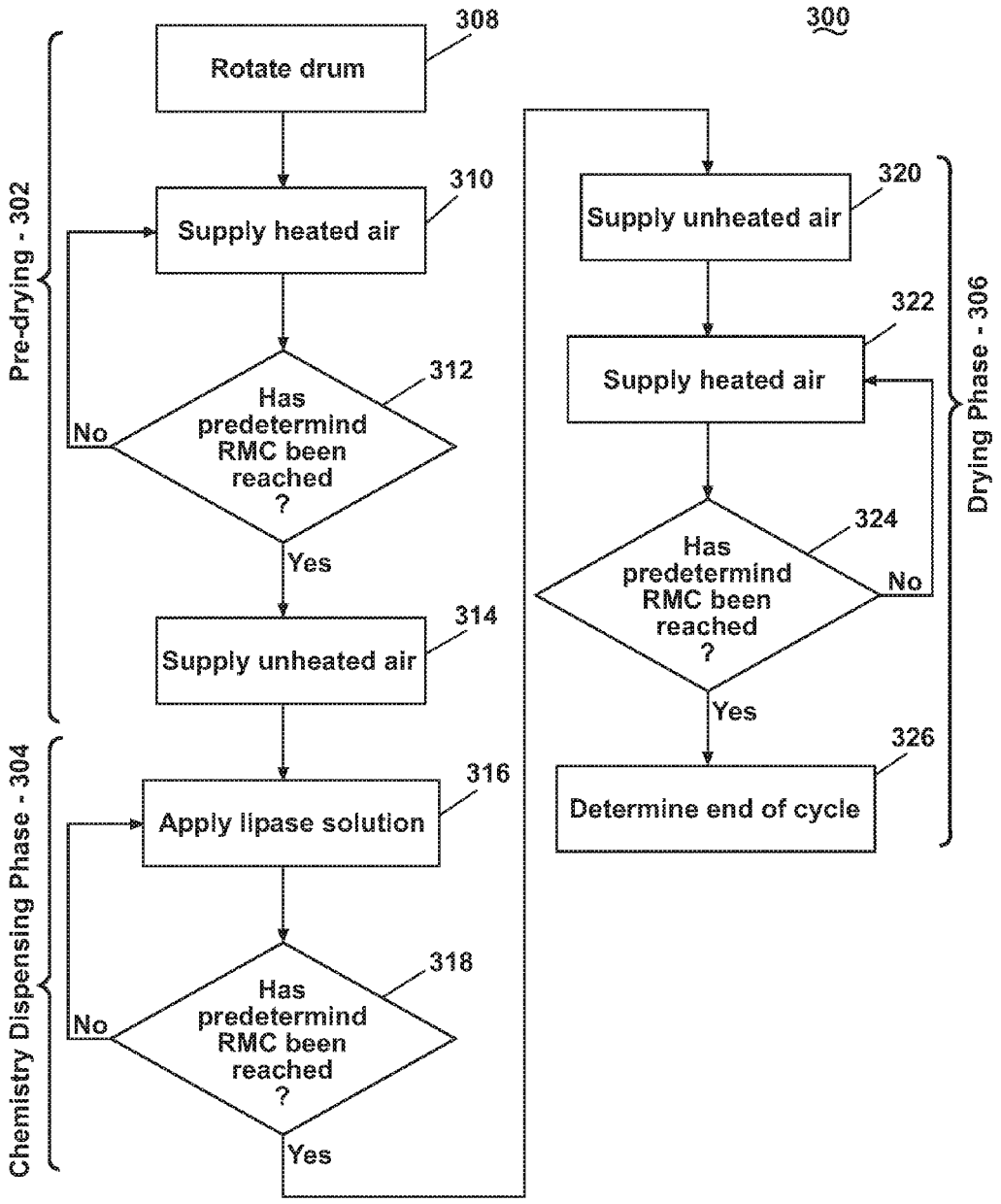
FIG. 6 is a flow chart illustrating a method for dispensing a lipase solution to a load of laundry according to a fourth embodiment of the invention.

FIG. 6 illustrates a method 300 that may be used with the method 200 illustrated in FIG. 5 to complete a cycle of operation in the clothes dryer 110 to dispense a lipase solution at 210. While the method 300 is described for use with the method 200, it is within the scope of the invention for the method 300 to be independent of the method 200. The method 300 may be completed if the user selects a cycle of operation at 204 that is typically conducted on moist laundry, such as a normal drying cycle or a delicates drying cycle, in which it is assumed the laundry retains some amount of moisture that the user desires to remove. For the purposes of discussion, the method 300 may be considered to include 3 phases: a pre-drying phase 302, a chemistry dispensing phase 304 and a drying phase 306. The description of the method 300 as having 3 phases is for illustrative purposes only and is not meant to limit the method 300 in any manner as the method 300 may include fewer phases or additional phases.

As illustrated in FIG. 6, the pre-drying phase 302 may include rotating the drum 128 at 308 at a tumbling speed to tumble the laundry within the treating chamber 134. At 310 the blower 156 and the heating element 146 may be activated to supply heated air to the treating chamber 134. The rotation of the drum 138 at 308 and the supply of heated air at 310 may be continued to remove moisture from the load until the laundry load reaches a predetermined remaining moisture content (RMC). The RMC of the laundry load may be determined using any suitable method and may be based on the output from the moisture sensor 184 as previously described.

At 312, if the controller 114 determines that the laundry has reached the predetermined RMC, the heating element 146 is deactivated and unheated air is supplied to the treating chamber 134 while the drum 128 is rotating at a tumbling speed at 314 for a predetermined amount of time. The predetermined amount of time may be fixed and independent of load amount. Alternatively, the predetermined amount of time may be based on the load amount, such as the load amount determined at 208 in the method 200.

The chemistry dispensing phase 304 may include applying a lipase solution to the laundry through the dispensing system 164 at 316. The lipase solution may include one or more lipases and one or more additional components, as discussed above. The lipase solution may be applied until the laundry reaches a predetermined RMC, as determined at 318. The determination of the RMC at 318 may be determined using the moisture sensor 184 in a manner similar to that at 312 in the pre-drying phase 302. If it is determined that the predetermined RMC has not been reached at 318, the method 300 may return to 316 to apply additional lipase solution. The lipase solution may be added continuously at 316 until the predetermined RMC has been reached. Alternatively, the lipase solution may be added in discrete increments until the predetermined RMC has been reached. Similarly, the determination of the RMC at 318 may be made continuously throughout the chemistry dispensing phase 304 or at predetermined intervals. The drum 128 may continue to tumble throughout the chemistry dispensing phase 304 or at specific intervals.

Once the predetermined RMC has been reached, as determined at 318, the controller 114 may activate the blower 156 to supply unheated air to the treating chamber 134 at 320 for a predetermined amount of time. This may be considered the start of the drying phase 306. The predetermined amount of time may be independent of the load amount or based on the load amount, such as may be determined at 208 in the method 200. The drum 128 may also be rotated to tumble the laundry within the treating chamber 134 during the supply of unheated air at 320. The supply of unheated air and tumbling of the laundry at 320 may promote more uniform dispersion of the lipase solution on the laundry.

At 322 the controller 114 may activate the heating element 146 and the blower 156 to supply heated air to the treating chamber 134. The controller 114 may also control the motor 160 to rotate the drum 128 at a tumbling speed such that the laundry is tumbled during the supply of heated air at 322. The heated air may be supplied at 322 to heat the laundry within the treating chamber 134 to a predetermined temperature corresponding to a temperature at which the lipase solution exhibits a desired optimal activity. For example, the Lipolase chemistry available from Novozymes exhibits a maximum lipolytic activity around 60° C. If the Lipolase solution is dispensed at 316, heated air may be supplied to the treating chamber 134 at 322 to heat the laundry to approximately 60° C. to optimize the lipolytic activity of the treatment on the laundry. The temperature, airflow rate and cycling on/off time of the heater 146 and the blower 156 may be controlled by the controller 114 to heat the laundry to the desired temperature. The supply of heated air may continue until the laundry reaches a predetermined RMC as determined at 324. The determination of the end of the cycle at 326 may be based on the laundry reaching a predetermined RMC, a predetermined temperature, a predetermined time after the laundry reaches the predetermined RMC at 324 or the completion of a cool down cycle.

The pre-drying phase 302 may be used to bring the RMC of the laundry down to a predetermined level corresponding to the optimal RMC of the lipase solution such that when the lipase solution is applied to the laundry at 316, the total RMC is a predetermined amount above the optimal RMC. As the laundry is dried during the drying phase 306, the activity of the lipase solution may increase as the laundry is dried down to the RMC corresponding to the optimal RMC of the lipase solution. For example, if the lipase solution exhibits optimal activity on fabric having an RMC of approximately 30-40%, during the pre-drying phase 302, the RMC of the laundry may be decreased to approximately 30-40%. The lipase solution may then be applied at 316 to bring the RMC of the laundry up to the final amount of 40-50% and the optimal RMC for the lipase solution may be reached as the laundry is dried during the drying cycle 306.

Applying the lipase solution to the laundry load to bring the RMC to a level slightly above the optimal RMC for the lipase solution and then drying down to the optimal RMC provides an opportunity for the lipase activity as a function of the RMC to increase as the temperature of the laundry is increasing to the predetermined temperature. The optimization of both the RMC and the temperature of the load may result in an additive or synergistic effect on the activity of the lipase solution such that the activity of the lipase solution under the optimal RMC and temperature conditions is greater than the activity of the lipase solution under conditions in which only one of the conditions is optimized. If the lipase solution was applied to the laundry load to bring the RMC level to the optimal RMC level, the activity of the lipase solution as a function of the RMC would be optimized at the start of the drying phase 306 and decrease during the course of the drying phase 306 as the RMC was decreasing.

Because the method 300 is typically used on loads that contain a higher moisture content than is desired at the end of the cycle of operation, such as loads that have been recently washed, the RMC of the laundry is typically much higher than the optimal RMC for the enzyme solution. Pre-drying the laundry to within 10-20% of the desired final RMC may save energy and time by not removing more moisture from the laundry than is necessary. The 10-20% of the moisture that is re-applied to the laundry by the application of the lipase solution at 316 balances the energy and time saving benefits of not over-drying the laundry with the desire to apply enough of the lipase solution at 316 such that it may be uniformly applied to the laundry. Applying the lipase solution near the optimal RMC rather than at the start of the cycle may also prevent the lipase solution from being overly diluted by excess moisture that may be present in the laundry. In addition, the application of the lipase solution to laundry that is already moist may increase the distribution of the lipase solution onto the laundry. The supply of unheated air and tumbling of the laundry at 320 may also improve the distribution of the lipase solution onto the laundry.

The supply of heated air at 322 may be used to heat the laundry to a predetermined temperature to dry the laundry and to optimize the activity of the lipase solution on the fabric. For example, if the lipase solution exhibits optimal activity at 60° C., heated air may be supplied to heat the laundry to a temperature of approximately 55-65° C. at 322. The lipolytic activity of the lipase solution may be permanently heat inactivated, by supplying heated air to heat the laundry to a temperature above the heat inactivation temperature. For example, the determination of the end of the cycle at 326 may include the application of heated air to heat the laundry at or above the inactivation temperature for a brief period of time to inactivate the lipase solution prior to ending the cycle. Alternatively, if the lipase solution is not heat inactivated, the lipases may be reactivated during a subsequent wash process, thus potentially making it easier to remove stains during the wash process.

Figure 7:
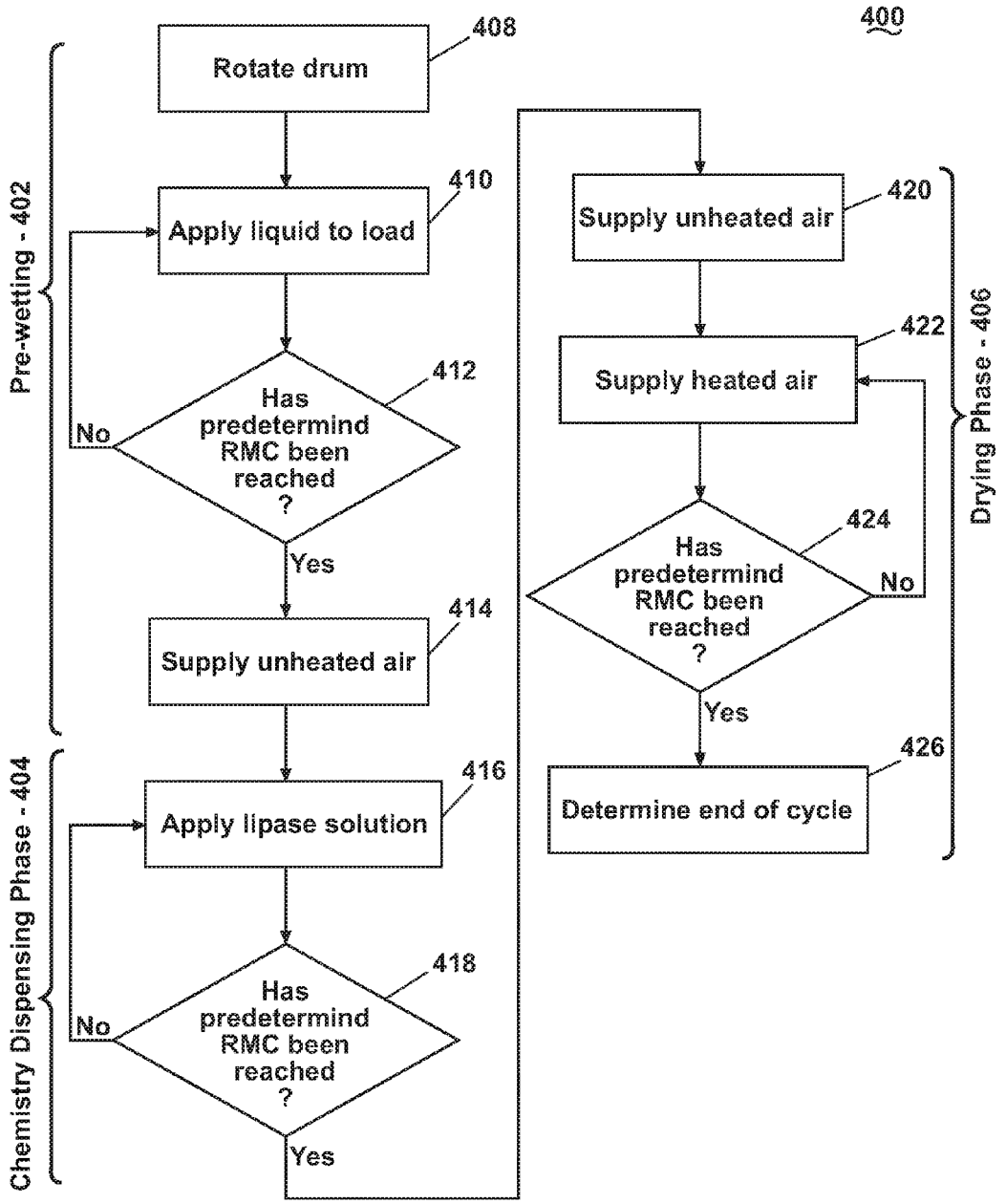
FIG. 7 is a flow chart illustrating a method for dispensing a lipase solution to a load of laundry according to a fifth embodiment of the invention.

FIG. 7 illustrates a method 400 that may be used with the method 200 illustrated in FIG. 5 to complete a cycle of operation in the clothes dryer 110 to dispense a lipase solution at 210. While the method 400 is described for use with the method 200, it is within the scope of the invention for the method 400 to be independent of the method 200. The method 400 may be completed if the user selects a cycle of operation at 204 that is typically conducted on dry laundry, such as a refresh cycle, a deodorizing cycle or a touch-up/wrinkle-removing cycle, for example. For the purposes of discussion, the method 400 may be considered to include 3 phases: a pre-wetting phase 402, a chemistry dispensing phase 404 and a drying phase 406. The description of the method 400 as having 3 phases is for illustrative purposes only and is not meant to limit the method 400 in any manner as the method 400 may include fewer phases or additional phases.

As illustrated in FIG. 7, the pre-wetting phase 402 may include rotating the drum 128 at 408 at a tumbling speed to tumble the laundry within the treating chamber 134. At 410 the dispensing system 164 may add liquid to the laundry load to moisten the laundry. The liquid added at 410 may be water that may or may not include additional components such as a fragrance, for example. Alternatively, the liquid may be a buffer solution having a pH suitable for use with the lipase solution. The liquid may be added at 410 continuously or in discrete increments until the predetermined RMC is reached. At 412, the controller 114 determines if the laundry has reached the predetermined RMC. The determination at 412 may be done continuously or at predetermined intervals during the cycle of operation using one or more moistures sensors 184. It is also within the scope of the invention for the RMC to be determined prior to adding any liquid at 410. If it is determined that the laundry is already at the predetermined RMC, no additional liquid may need to be applied at 410.

When the controller 114 determines that the predetermined RMC has been reached, at 414 the blower 156 may be activated and unheated air may be supplied to the treating chamber 134 while the drum 128 is rotating at a tumbling speed for a predetermined amount of time. The predetermined amount of time may be fixed and independent of load amount. Alternatively, the predetermined amount of time may be based on the load amount, such as the load amount determined at 208 in the method 200. The tumbling of the load while supplying unheated air at 414 may help to uniformly distribute the liquid dispensed at 410 onto the laundry load.

The chemistry dispensing phase 404 may include applying a lipase solution to the laundry through the dispensing system 164 at 416. The lipase solution may be applied until the laundry reaches a predetermined RMC, as determined at 418. The determination of the RMC at 418 may be determined using the moisture sensor 184 in a manner similar to that at 412 in the pre-wetting phase 402. If it is determined that the predetermined RMC has not been reached at 418, the method 400 may return to 416 to apply additional lipase solution. The lipase solution may be added continuously at 416 until the predetermined RMC has been reached. Alternatively, the lipase solution may be added in discrete increments until the predetermined RMC has been reached. Similarly, the determination of the RMC at 418 may be made continuously throughout the chemistry dispensing phase 404 or at predetermined intervals. The drum 128 may continue to tumble throughout the chemistry dispensing phase 404 or at specific intervals.

Once the predetermined RMC has been reached, as determined at 418, the controller 114 may activate the blower 156 to supply unheated air to the treating chamber 134 at 420 for a predetermined amount of time. This may be considered the start of the drying phase 406. The predetermined amount of time may be independent of the load amount or based on the load amount, such as may be determined at 208 in the method 200. The drum 128 may also be rotated to tumble the laundry within the treating chamber 134 during the supply of unheated air at 420. The supply of unheated air and tumbling of the laundry at 3420 may promote more uniform application of the lipase solution onto the laundry.

At 422 the controller 114 may activate the heating element 146 and the blower 156 to supply heated air to the treating chamber 134. The controller 114 may also control the motor 160 to rotate the drum 128 at a tumbling speed such that the laundry is tumbled during the supply of heated air at 422. The heated air may be supplied at 422 to heat the laundry within the treating chamber 134 to a predetermined temperature corresponding to a temperature at which the lipase solution exhibits optimal activity. As discussed above with reference to the method 300, if the lipase solution dispensed at 416 exhibits optimal lipolytic activity at 60° C., the heated air may be supplied to the treating chamber 134 at 422 to heat the laundry to approximately 60° C. The temperature, airflow rate and cycling on/off time of the heater 146 and the blower 156 may be controlled by the controller 114 to heat the laundry to the desired temperature. The supply of heated air may continue until the laundry reaches a predetermined RMC as determined at 424. The determination of the end of the cycle at 426 may be based on the laundry reaching a predetermined RMC, a predetermined temperature, a predetermined time after the laundry reaches the predetermined RMC at 424 or the completion of a cool down cycle.

The pre-wetting phase 402 may be used to moisten the laundry to a predetermined level such that when the lipase solution is applied to the laundry at 416, the total RMC corresponds to the RMC at which the lipase solution exhibits optimal activity. For example, if the lipase solution exhibits optimal activity on fabric having an RMC of approximately 20-40%, during the pre-wetting phase 402, liquid may be applied to the laundry such that the RMC of the laundry may be increased to approximately 10%. The lipase solution may then be applied at 416 to bring the RMC of the laundry up to a final amount of approximately 30% corresponding to an optimal RMC for the lipase solution.

Because the method 400 is typically used on laundry that is dry and contains very little moisture, the RMC of the laundry is typically much lower than the optimal RMC for the enzyme solution. It has been found that pre-wetting the laundry provides the laundry with some amount of moisture to improve the distribution of the lipase solution onto the laundry when it is added at 416 compared to adding the lipase solution to dry laundry that contains no water or only negligible of amounts of water (such as may be present based on the humidity of the environment in which the laundry is stored). Pre-wetting the laundry to within 20% of the desired final RMC may save energy and time by not adding more moisture to the laundry than is necessary, as this moisture will then be subsequently removed in the drying phase 406. In addition, the 10-20% of the moisture that is re-applied to the laundry by the application of the lipase solution at 416 balances the energy and time saving benefits of not over-wetting the laundry with the desire to apply enough of the lipase solution at 416 such that it may be uniformly applied to the laundry. By not over-wetting the laundry load by the application of liquid at 410 and the application of the lipase solution at 416, the difference in time between a cycle of operation that includes the application of a lipase solution and a corresponding cycle of operation that does not include the application of a lipase solution may be minimized. The supply of unheated air and tumbling of the laundry at 420 may also improve the distribution of the lipase solution onto the laundry.

The supply of heated air at 422 may be used to heat the laundry to a predetermined temperature to dry the laundry and to optimize the activity of the lipase solution on the fabric. For example, if the lipase solution exhibits optimal activity at 60° C., heated air may be supplied to heat the laundry to a temperature of approximately 55-65° C. at 422. The lipolytic activity of the lipase solution may be permanently heat inactivated, by supplying heated air to heat the laundry to a temperature above the heat inactivation temperature. For example, the determination of the end of the cycle at 326 may include the application of heated air to heat the laundry at or above the inactivation temperature for a brief period of time to inactivate the lipase solution prior to ending the cycle. Alternatively, if the lipase solution is not heat inactivated, the lipases may be reactivated during a subsequent wash process, thus potentially making it easier to remove stains during the wash process.

While the supply of heated air at 422 is described as including a single phase in which the laundry is heated to a single, maximum predetermined temperature, the supply of heated air at 422 may include an additional phase in which the laundry is first heated to a predetermined temperature less than the maximum predetermined temperature. For example, it has been found that supplying heated air to the treating chamber 134 to heat the laundry to 35-40° C. for a predetermined time prior to heating the laundry to the maximum temperature to optimize the lipase activity, which in the example above is 55-65° C., may help improve the distribution of the lipase onto the laundry fabric. This benefit may be more noticeable on laundry that is initially dry before being placed in the treating chamber 134.

The concentration of the lipase applied to the laundry according to any of the embodiments of the invention may vary depending on the lipase solution and the size of the load. For example, for Lipolase®, a solution having a lipase concentration in the range of approximately 20-100 ppm, corresponding to 2-10 kilo Lipase units (kLU, a measure of lipase activity), may be applied to the laundry. The exact concentration of the lipase solution applied to the laundry may vary depending on the amount of laundry, the type of laundry and the cycle of operation, for example. The lipase solution may be applied to the load to achieve a desired kLU per load amount or based on the fabric type or selected cycle of operation. The kLU's applied to the load may be varied by changing the concentration of the lipase solution applied to the load and/or changing the amount of lipase solution applied to the load. For example, larger laundry loads may require a higher concentration or a larger amount of lipase solution to achieve a desired kLU per load amount. In another example, if the user selected cycle of operation indicates a higher degree of soiling, a higher concentration or a larger amount of lipase solution may be applied to the laundry.

The embodiments of the invention may be used with laundry treating appliances that do not have a liquid drain system, such as a clothes dryer or a revitalizing machine. In these types of appliances, if an excess amount of liquid is dispensed, it could pool or puddle in the treating chamber, which may accelerate the normal wear and tear of the structure forming the treating chamber. A current of subsequent laundry load may absorb some of the excess liquid, resulting in excessively long cycle times and/or an undesired spot treatment, over-treatment or unwanted treatment. Therefore, in a dryer without a liquid draining system, the amount of liquid dispensed should be controlled based on not only on the size of the load and the selected cycle, but also based on the environmental conditions within the treating chamber. The control should be such that there is no residual chemistry of, if there is residual chemistry, the amount of residual chemistry will not undesirably negatively impact the current or subsequent laundry loads. Examples of the environmental conditions include the presence or absence of a drain system or whether the temperature and air flow conditions are capable of evaporating the dispensed liquid such any excess liquid remaining in the treating chamber at the end of a cycle will not negatively impact the treating chamber or the current or subsequent laundry load. When the embodiments of the invention are used in a laundry treating appliance that does have a liquid drain system, such as a combination washer/dryer, these conditions may become less of a concern as excess liquid may be drained from the treating chamber through the drain system of the appliance.

The embodiments of the invention described herein provide a method for applying a lipase solution to laundry to facilitate removal of oily stains already present on the laundry and may also provide a functional finish which may protect laundry items by making future oil stains easier to remove. A cycle of operation in a laundry treating appliance may be controlled to optimize the stain removal activity of a lipase solution on both dry laundry, such as during a refresh cycle, and moist laundry, such as during a normal drying cycle. The cycle of operation in the laundry treating appliance may also be controlled such that the lipases on the laundry fabric are not permanently inactivated at the completion of the cycle of operation and may be reactivated during a subsequent wash cycle, which may make it easier to remove stains. In addition, applying the lipase solution during a cycle of operation in a laundry treating appliance may avoid the potential inactivation of the lipases by surfactants, proteases and bleaches that may be present during a wash cycle in a clothes washer.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of treating laundry in a laundry treating appliance having an air supply system and a heating system both operably coupled to and controlled by a controller to supply heated air to a treating chamber, the method comprising:

pre-treating by adding moisture to the laundry in the treating chamber until a sensed moisture content of the laundry satisfies a first predetermined moisture content threshold;

after the satisfying of the first predetermined moisture content threshold, applying an enzyme solution to the laundry in the treating chamber until the sensed moisture content of the laundry is greater than a second predetermined moisture content threshold, which is greater than the first predetermined moisture content threshold; and after the application of the enzyme solution, supplying the heated air to the treating chamber to reduce the sensed moisture content of the laundry.

2. The method of claim 1, wherein pre-treating the laundry in the treating chamber until the sensed moisture content of the laundry satisfies the first predetermined moisture content threshold comprises wetting the laundry in the treating chamber until the sensed moisture content of the laundry satisfies the first predetermined moisture content threshold.

3. The method of claim 1, further comprising determining an amount of the laundry before the application of the enzyme solution to the laundry, wherein at least one of an amount of enzyme solution or a concentration of enzyme solution applied to the laundry is based on the amount of the laundry.

4. The method of claim 1 wherein the first predetermined moisture content threshold is about 10%.

5. The method of claim 1 wherein the second predetermined moisture content threshold is about 30%.

6. The method of claim 1 wherein the supplying of the heated air includes supplying heated air at a temperature less than the heat inactivation temperature of the enzyme solution.

7. The method of claim 1 wherein the supplying of the heated air includes a first supply of heated air at a first temperature and a second supply of heated air at a second temperature, and wherein the second temperature is greater than the first temperature.

8. The method of claim 7 wherein the first supply of heated air is supplied for a predetermined amount of time based on an amount of laundry and the second supply of heated air is supplied until the sensed moisture content of the laundry satisfies a third predetermined moisture content threshold and wherein the first temperature is less than the heat activation temperature of the enzyme solution.

9. The method of claim 8 wherein the second temperature is less than the heat inactivation temperature of the enzyme solution.

10. The method of claim 8 wherein the second temperature is equal to or greater than the heat inactivation temperature of the enzyme solution.

11. The method of claim 1 wherein the enzyme solution has a pH in the range of about 7-11.

12. The method of claim 11 wherein the enzyme solution comprises at least one of a phosphate and carbonate buffer solution.

13. The method of claim 1 wherein the pre-treating by adding moisture to the laundry comprises wetting the laundry in a rotatable drum and the rotatable drum defines the treating chamber.

14. The method of claim 1 wherein the supplying of the heated air comprises reducing the sensed moisture content of the laundry to dry the laundry to a third predetermined moisture content.

15. The method of claim 1 wherein the supplying of the heated air comprises supplying heated air at a temperature less than the heat inactivation temperature of the enzyme solution.

* * * * *